US007913362B2

(12) United States Patent
Saeger et al.

(10) Patent No.: US 7,913,362 B2
(45) Date of Patent: Mar. 29, 2011

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventors: Nicole Saeger, Aachen (DE); Johannes Boβmann, Mönchengladbach (DE); Thomas Schmitz, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 356 days.

(21) Appl. No.: 12/163,700

(22) Filed: Jun. 27, 2008

(65) Prior Publication Data

US 2009/0000075 A1 Jan. 1, 2009

(30) Foreign Application Priority Data

| | | |
|---|---|---|
| Jun. 29, 2007 | (DE) | 10 2007 030 471 |
| Jun. 29, 2007 | (DE) | 20 2007 010 686 U |
| Dec. 7, 2007 | (DE) | 10 2007 059 249 |
| Dec. 7, 2007 | (DE) | 20 2007 018 299 U |
| Feb. 28, 2008 | (DE) | 10 2008 011 546 |

(51) Int. Cl.
*D01G 19/00* (2006.01)

(52) U.S. Cl. ..... 19/217

(58) Field of Classification Search ..... 19/115 R, 19/215, 216, 217
See application file for complete search history.

(56) References Cited

U.S. PATENT DOCUMENTS

| | | | |
|---|---|---|---|
| 1,408,780 | A | 3/1922 | Schleifer |
| 1,425,059 | A | 8/1922 | Schleifer |
| 1,694,432 | A | 12/1928 | Schleifer |
| 1,708,032 | A | 4/1929 | Schleifer |
| 1,715,473 | A | 6/1929 | Schleifer |
| 1,799,066 | A | 3/1931 | Schleifer |
| 2,044,460 | A | 6/1936 | Bartram et al. |
| 2,962,772 | A | 12/1960 | Draving et al. |

(Continued)

FOREIGN PATENT DOCUMENTS

| | | | |
|---|---|---|---|
| DE | 367482 | C | 1/1923 |

(Continued)

OTHER PUBLICATIONS

German Patent Office Search Report, dated Aug. 8, 2007, issued in related German Application No. 10 2006 050 384.8, and English language translation of Section C.

(Continued)

*Primary Examiner* — Shaun R Hurley
(74) *Attorney, Agent, or Firm* — Venable LLP; Robert Kinberg; Steven J. Schwarz

(57) ABSTRACT

In an apparatus for the fiber-sorting or fiber-selection of a fiber bundle comprising textile fibers, especially for combing, which is supplied by a supply device to a fiber-sorting device, especially a combing device, having clamping devices, which clamp the fiber bundle at a distance from its free end, for combing to remove non-clamped constituents, at least one take-off device with a sliver-forming element is present, downstream of which is a drafting system. To increase productivity and improve the combed sliver, the fiber-sorting device has at least two rotatably mounted rollers rotating rapidly without interruption, having the clamping devices and between the sliver-forming element and the drafting system the at least one fiber sliver is present in the form of a fiber structure having a width greater than its height, for example, following spreading by a web-spreader.

21 Claims, 11 Drawing Sheets

U.S. PATENT DOCUMENTS

| | | | | |
|---|---|---|---|---|
| 3,108,333 | A | 10/1963 | Schleifer | |
| 4,270,245 | A | 6/1981 | Stewart et al. | |
| 5,007,623 | A | 4/1991 | Unkuri et al. | |
| 5,343,686 | A | 9/1994 | Buchner et al. | |
| 5,404,619 | A | 4/1995 | Jorg | |
| 5,457,851 | A | 10/1995 | Mondini | |
| 5,502,875 | A | 4/1996 | Stolz et al. | |
| 5,796,220 | A | 8/1998 | Clapp et al. | |
| 6,163,931 | A | 12/2000 | Leifeld | |
| 6,173,478 | B1 | 1/2001 | Patelli et al. | |
| 6,216,318 | B1 | 4/2001 | Leifeld | |
| 6,235,999 | B1 | 5/2001 | Rubenach | |
| 6,295,699 | B1 * | 10/2001 | Temburg | 19/239 |
| 6,499,194 | B1 | 12/2002 | Gresser et al. | |
| 6,611,994 | B2 | 9/2003 | Bischofberger et al. | |
| 7,173,207 | B2 | 2/2007 | Losbrock et al. | |
| 2002/0124354 | A1 | 9/2002 | Pferdmenges et al. | |
| 2003/0005551 | A1 | 1/2003 | Schurenkramer et al. | |
| 2003/0029003 | A1 | 2/2003 | Breuer et al. | |
| 2003/0070260 | A1 | 4/2003 | Rubenach | |
| 2003/0154572 | A1 | 8/2003 | Pferdmenges et al. | |
| 2004/0040121 | A1 | 3/2004 | Schmitz | |
| 2004/0128799 | A1 | 7/2004 | Hosel et al. | |
| 2005/0076476 | A1 * | 4/2005 | Temburg | 19/236 |
| 2005/0198783 | A1 | 9/2005 | Rubenach | |
| 2005/0278900 | A1 | 12/2005 | Dammig | |
| 2006/0260100 | A1 | 11/2006 | Duda et al. | |
| 2007/0180658 | A1 | 8/2007 | Saeger et al. | |
| 2007/0180659 | A1 | 8/2007 | Saeger et al. | |
| 2007/0180660 | A1 | 8/2007 | Saeger et al. | |
| 2007/0266528 | A1 | 11/2007 | Farber et al. | |
| 2008/0092339 | A1 | 4/2008 | Bossman et al. | |
| 2009/0000064 | A1 | 1/2009 | Saeger et al. | |
| 2009/0000065 | A1 | 1/2009 | Saeger et al. | |
| 2009/0000066 | A1 | 1/2009 | Saeger et al. | |
| 2009/0000067 | A1 | 1/2009 | Leder et al. | |
| 2009/0000068 | A1 | 1/2009 | Saeger et al. | |
| 2009/0000069 | A1 | 1/2009 | Saeger et al. | |
| 2009/0000070 | A1 | 1/2009 | Saeger et al. | |
| 2009/0000071 | A1 | 1/2009 | Saeger et al. | |
| 2009/0000072 | A1 | 1/2009 | Saeger et al. | |
| 2009/0000073 | A1 | 1/2009 | Saeger et al. | |
| 2009/0000074 | A1 | 1/2009 | Bossmann | |
| 2009/0000076 | A1 | 1/2009 | Bossmann et al. | |
| 2009/0000077 | A1 | 1/2009 | Saeger et al. | |
| 2009/0000078 | A1 | 1/2009 | Saeger et al. | |
| 2009/0000079 | A1 | 1/2009 | Bossmann | |

FOREIGN PATENT DOCUMENTS

| | | | |
|---|---|---|---|
| DE | 382169 | C | 9/1923 |
| DE | 399885 | C | 7/1924 |
| DE | 489 420 | C | 1/1930 |
| DE | 30 48 501 | A1 | 7/1982 |
| DE | 103 20 452 | A1 | 11/2004 |
| EP | 1 586 682 | A1 | 10/2005 |
| WO | WO 2006/012758 | A1 | 2/2006 |

OTHER PUBLICATIONS

German Patent Office Search Report, dated Jul. 10, 2007, Issued in related German Patent Application No. 10 2006 050 453.4, and partial English-language translation.

U.S. Office Action dated Feb. 26, 2010, issued in related U.S. Appl. No. 12/149,506.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATIONS

This application claims priority from German Utility Model No. 20 2007 010 686.9 dated Jun. 29, 2007, German Utility Model No. 20 2007 018 299.6 dated Dec. 7, 2007, and German Patent Application No. 10 2008 011 546.0 dated Feb. 28, 2008, the entire disclosure of each of which is incorporated herein by reference.

BACKGROUND OF THE INVENTION

The invention relates to an apparatus for the fibre-sorting or selection of a fibre bundle comprising textile fibres, especially for combing, which is supplied by means of supply means to a fibre-sorting device, especially to a combing device, in which clamping devices are provided, which clamp the fibre bundle at a distance from its free end and mechanical means are present which generate a combing action from the clamping site to the free end of the fibre sliver in order to loosen and remove non-clamped constituents, such as, for example, short fibres, neps, dust and the like from the free end, wherein for removal of the combed fibre material at least one take-off means with a sliver-forming element is present, downstream of which is a drafting system.

In practice, combing machines are used to free cotton fibres or woollen fibres of natural impurities contained therein and to parallelise the fibres of the fibre sliver. For that purpose, a previously prepared fibre bundle is clamped between the jaws of the nipper arrangement so that a certain sub-length of the fibres, known as the "fibre tuft", projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre tuft and carry it onwards. The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre tuft supplied by the nipper assembly, a top comb and a fixed-position detaching device for detaching the combed-out fibre tuft from the nipper assembly. The lap ribbon supplied to the nipper assembly is here fed via a feed cylinder to a detaching roller pair. The fibre tuft protruding from the opened nipper passes onto the rearward end of a combed sliver web or fibre web, whereby it enters the clamping nip of the detaching rollers owing to the forward movement of the detaching rollers. The fibres that are not retained by the retaining force of the lap ribbon, or by the nipper, are detached from the composite of the lap ribbon. During this detaching operation, the fibre tuft is additionally pulled by the needles of a top comb. The top comb combs out the rear part of the detached fibre tuft and also holds back neps, impurities and the like. The top comb, for which in structural terms space is required between the movable nipper assembly and the movable detaching roller, has to be constantly cleaned by having air blown through it. For piercing into and removal from the fibre bundle, the top comb has to be driven. Finally, the cleaning effect at this site of jerky movement is sub-optimal. Owing to the differences in speed between the lap ribbon and the detaching speed of the detaching rollers, the detached fibre tuft is drawn out to a specific length. Following the detaching roller pair is a guide roller pair. During this detaching operation, the leading end of the detached or pulled off fibre bundle is overlapped or doubled with the trailing end of the fibre web. As soon as the detaching operation and the piecing operation have ended, the nipper returns to a rear position in which it is closed and presents the fibre tuft protruding from the nipper to a comb segment of a circular comb for combing out. Before the nipper assembly now returns to its front position again, the detaching rollers and the guide rollers perform a reversing movement, whereby the trailing end of the fibre web is moved backwards by a specific amount. This is required to achieve a necessary overlap for the piecing operation. In this way, a mechanical combing of the fibre material is effected. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the ecartement, that is to say the distance between the nipper lip of the lower nipper plate and the clamping point of the detaching cylinder, is structurally and spatially limited. The rotational speed of the detaching rollers and the guide rollers, which convey the fibre bundles away, is matched to the upstream slow combing process and is limited by this. A further drawback is that each fibre bundle is clamped and conveyed by the detaching roller pair and subsequently by the guide roller pair. The clamping point changes constantly owing to the rotation of the detaching rollers, i.e. there is a constant relative movement between the rollers effecting clamping and the fibre bundle. All fibre bundles have to pass through the one fixed-position detaching roller pair and the one fixed-position guide roller pair in succession, which represents a further considerable limitation of the production speed. The fibre slivers F produced at the individual combing heads are delivered by means of a device not shown more specifically onto a conveyor table T and are transferred, lying one next to the other, to a subsequent drafting system S. The fibre slivers are drafted in the drafting system S and subsequently combined to form a common combing fibre sliver FB. The conveying speed of the eight fibre slivers on the conveyor table to the drafting system is matched to the upstream slow combing process and is limited by this, that is, progresses at relatively low speed. A high, substantially increased conveying speed, in particular without unevenness in the eight fibre slivers, is not possible with this conveying device.

SUMMARY OF THE INVENTION

It is an aim of the invention to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres having:

a fibre sorting device in which clamping devices are provided which each clamp a bundle of the textile fibres at a distance from its free end;

a supply device for supplying the fibre bundle to the fibre-sorting device;

at least one mechanical device for generating a combing action from the clamping site to the free end of the fibre bundle in order to loosen and remove non-clamped constituents;

a take-off device comprising at least one sliver-forming element; and a drafting device downstream of the or each sliver-forming element;

wherein the fibre-sorting device comprises at least first and second rotatably mounted rollers that, in use, rotate rapidly without interruption, the clamping devices for the fibre bundles being distributed spaced apart in the region of the periphery of said rollers, and between the at least one sliver-forming element and the drafting device the combed fibre material is present in the form of a fibre structure, the width of which is greater than its height in cross-section.

By implementing the functions of clamping and moving the fibre bundles to be combed-out on at least two rotating rollers, high operating speeds (nip rates) are achievable—unlike the known apparatus—without large mass accelerations and reversing movements. In particular, the mode of operation is continuous. When two high-speed rollers are used, a very substantial increase in hourly production rate (productivity) is achievable which had previously not been considered possible in technical circles. A further advantage is that the rotary rotational movement of the rollers with the plurality of clamping devices leads to an unusually rapid supply of a plurality of fibre bundles per unit of time to the first roller and to the second roller. In particular the high rotational speed of the rollers allows production to be substantially increased.

To form the fibre bundle, the fibre sliver pushed forward by the feed roller is clamped at one end by a clamping device and detached by the rotary movement of the turning rotor. The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is transferred from the turning rotor onto the combing rotor the ends of the fibre bundle are reversed: the clamping device on the combing rotor grips and clamps the end with the long fibres, so that the region with the short fibres projects from the clamping device and lies exposed and can thereby be combed out.

The fibre bundles are—unlike the known apparatus—held by a plurality of clamping devices and transported under rotation. The clamping point at the particular clamping devices therefore remains constant until the fibre bundles are transferred to the first or second roller respectively. A relative movement between clamping device and fibre bundle does not begin until after the fibre bundle has been gripped by the first and second roller respectively and in addition clamping has been terminated. Because a plurality of clamping devices is available for the fibre bundles, in an especially advantageous manner fibre bundles can be supplied to the first and second roller respectively one after the other and in quick succession, without undesirable time delays resulting from just a single supply device. A particular advantage is that the supplied fibre bundles on the first roller (turning rotor) are continuously transported. The speed of the fibre bundle and of the co-operating clamping elements is the same. The clamping elements close and open during the movement in the direction of the transported fibre material. The at least two rotating rollers comprise at least one first roller (the or each first roller preferably being a turning rotor) and at least one second roller (the or each second roller preferably being a combing rotor). The at least one second roller (that is, preferably a combing rotor) is arranged downstream of the at least one first roller (that is, preferably a turning rotor). With the apparatus according to the invention, a substantially increased productivity is achieved. A further particular advantage is that at high and maximum working speeds of the rotor combing machine, drafting of the produced combed fibre sliver is made considerably easier despite the high sliver weight (e.g. 20 ktex), in some cases the approximately circular sliver cross-section of sliver emerging from the sliver former, and the piecing sites present. The relatively flat construction of the fibre structure allows it to be introduced without problems into the roller nip of the feed rollers of the drafting system. In particular, the drafting is quite considerably improved inter alia by the fact that during the drafting process the fibres are securely gripped also in the two edge regions of the fibre structure. The height difference between the middle and the two edge regions of the fibre structure can be substantially eliminated. The working speed of the downstream drafting system is, of course, matched to the high feed speed.

In some embodiments, the combed fibre material (fibre web) is divided on or after the take-off device (for example, piecing roller) and each portion passes through a sliver-forming element to form in each case a fibre sliver.

In some embodiments, between a sliver-forming element and the drafting system there is an arrangement for expanding the width (spreading) of the fibre sliver. In other embodiments, a device for reforming the combed fibre material into a fibre structure having an essentially shallow cross-section is provided after the take-off means (piecing roller).

Where, as described above, the fibre material is divided, the web division may in one embodiment take place on the piecing roller. Instead, the web division may take place directly downstream of the piecing roller. Any suitable means may be used for the division. For example, division may be effected by a mechanical device or a pneumatic device. In one illustrative embodiment, the piecing roller has a separating element for example, a separating blade mounted thereon.

Advantageously, the at least two fibre slivers formed after web division pass into and through the drafting system.

In practice, the fibre sliver may be expanded in width to a thin fibre web. For example, curved guide means may be present to influence (expand) the cross-section of the fibre sliver or fibre slivers. Advantageously, elements for lateral limitation are associated with the guide means. Advantageously, at least one web width-expander is arranged upstream of the drafting system. In certain preferred embodiments, the contact surface of a guide element of the guide means with the fibre structure is convexly curved. In some embodiments, the contact surface may be non-moving. In other embodiments, the contact surface may be moving.

In a further embodiment, the form of the circumferential surfaces of the delivery rollers of the sliver-forming element may be used to expand the width of the fibre sliver. In yet another embodiment, the configuration of the circumferential surfaces of a pair of calender rollers may be used to expand the width of the fibre sliver. The delivery or calender rollers are advantageously, for that purpose, convexly shaped, for example, as barrel-shaped rollers.

In some embodiments, the sliver-forming element comprises a sliver funnel, from the outlet region of which a flat fibre structure is discharged. For example, the sliver-forming element may comprise a sliver funnel, the outlet region of which has a substantially rectangular cross-section.

In other embodiments, the outlet region of the sliver funnel is arranged in the roller nip between the delivery rollers. The arrangement may advantageously be such that the fibre structure leaving the sliver funnel has a substantially rectangular cross-section. In that case, the outlet of the web funnel is advantageously of sharp-edged construction and/or of slotted construction. Where there are two or more sliver-forming elements having rectangular or slotted outlets, the latter may advantageously be arranged in the lateral regions. It is preferred that the fibre structure passes with a substantially rectangular cross-section into and through the drafting system.

In some embodiments, following the sliver formation a stuffer box is present upstream or downstream of the drafting system. At least one conveying element for the fibre structure may be present between the sliver-forming element and the drafting system.

In some preferred embodiments, at least two take-off means (piecing rollers) and at least two sliver-forming elements are present. In that case, the at least two slivers so formed are advantageously delivered to a common drafting device.

In certain preferred embodiments, said at least first and second rollers comprise a turning rotor as a said first roller and a combing rotor as a said second roller. Advantageously, the turning rotor and the combing rotor have opposite directions of rotation.

In certain embodiments, for suction of the supplied fibre bundles at least one suction device is associated with the clamping devices in the region of transfer of the fibres bundle by the supply means onto the first roller and/or in the region of the take-up of the fibre material from the first roller onto the second roller.

The invention also provides an apparatus for the fibre-sorting or fibre-selection of a fibre bundle comprising textile fibres, especially for combing, which is supplied by means of supply means to a fibre-sorting device, especially a combing device, in which clamping devices are provided which clamp the fibre bundle at a distance from its free end, and mechanical means are present which generate a combing action from the clamping site to the free end of the fibre bundle, in order to loosen and remove non-clamped constituents, such as, for example, short fibres, neps, dust and the like from the free end, wherein for removal of the combed fibre material at least one take-off means with a sliver-forming element is present, downstream of which is a drafting system, characterised in that downstream of the supply means there are arranged at least two rotatably mounted rollers rotating rapidly without interruption, which are provided with clamping devices for the fibre bundle, which clamping devices are distributed spaced apart in the region of the periphery of the rollers, and between the at least one sliver-forming element and the drafting system the combed fibre material is present in the form of a fibre structure, for example, flat sliver or the like, the width of which is greater than its height in cross-section.

The combed fibre material (fibre web) is preferably divided on or after the take-off means (piecing roller) and each portion passes through a sliver-forming element to form in each case a fibre sliver. Through division of the web, instead of one fibre sliver with a relatively large diameter, at least two fibre slivers each having a smaller diameter are produced. The at least two fibre slivers form the flatter and wider fibre structure. Inter alia one or more of the following advantages may be achievable in that way:

- Reduction in the individual sliver weights to the customary weights of 5 to 10 ktex,
- Evening-out of the piecing point through different length feeds of the slivers to the drafting system, optionally adaptable to piecing point spacing,
- Evening-out of the piecing points through eccentric sliver formation,
- Doubling of the individual slivers before entry into the drafting system,
- Lighter-weight fibre slivers lying side by side are easier to process in the drafting system than one heavy sliver,
- Arrangement of the funnels for sliver formation as desired in cross direction of the machine (e.g. on the outside or centrally).

Preferably, between a sliver-forming element and the drafting system there is an arrangement for expanding the width (spreading) of the fibre sliver. Expansion of the width simultaneously reduces the height of the fibre sliver, resulting in the formation of the flat and wide fibre structure that permits the especially advantageous drafting.

Advantageously, a device for reforming the combed fibre material into a fibre structure having an essentially shallow cross-section is provided after the take-off means (piecing roller). In particular a sliver funnel having an approximately rectangular outlet cross-section facilitates reforming of the fibre sliver of approximately circular cross-section into the flat and wide fibre structure.

DETAILED DESCRIPTION OF CERTAIN PREFERRED EMBODIMENTS

Figure 1:
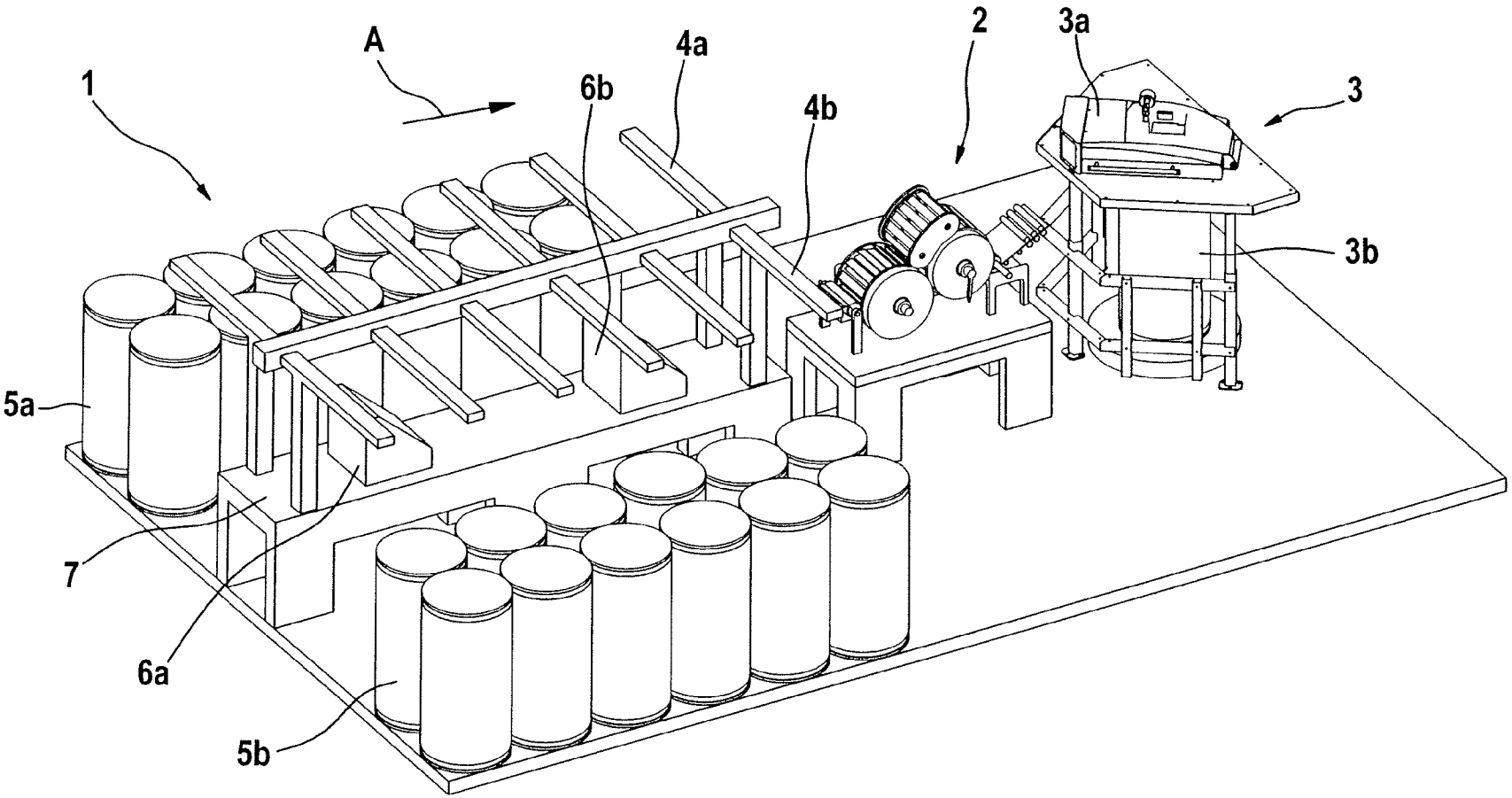
FIG. 1 is a diagrammatic perspective view of a device for combing fibre material, comprising a combing preparation device, a rotor combing machine and a fibre sliver-deposition device.

With reference to FIG. 1, a combing preparation machine 1 has a sliver-fed and lap-delivering spinning room machine and two feed tables 4*a*, 4*b* (creels) arranged parallel to one another, there being arranged below each of the feed tables 4*a*, 4*b* two rows of cans 5*a*, 5*b* containing fibre slivers (not shown). The fibre slivers withdrawn from the cans 5*a*, 5*b* pass, after a change of direction, into two drafting systems 6*a*, 6*b* of the combing preparation machine 1, which are arranged one after the other. From the drafting system 6*a*, the fibre sliver web that has been formed is guided over the web table 7 and, at the outlet of the drafting system 6*b*, laid one over the other and brought together with the fibre sliver web produced therein. By means of the drafting systems 6*a* and 6*b*, in each case a plurality of fibre slivers are combined to form a lap and drafted together. A plurality of drafted laps (two laps in the example shown) are doubled by being placed one on top of the other. The lap so formed is introduced directly into the supply device (feed element) of the downstream rotor combing machine 2. The flow of fibre material is not interrupted. The combed fibre web is delivered at the outlet of the rotor combing machine 2, passes through a funnel, forming a comber sliver, and is deposited in a downstream sliver-deposition device 3. Reference numeral A denotes the operating direction.

An autoleveller drafting system 50 (see FIG. 2) can be arranged between the rotor combing machine 2 and the sliver-deposition device 3. The comber sliver is thereby drafted.

In accordance with a further construction, more than one rotor combing machine 2 is provided. If, for example, two rotor combing machines are present, then the two delivered comber slivers 17 can pass together through the downstream autoleveller drafting system 50 and be deposited as one drafted comber sliver in the sliver-deposition device 3.

The sliver-deposition device 3 comprises a rotating coiler head 3*a*, by which the comber sliver can be deposited in a can 3*b* or (not shown) in the form of a can-less fibre sliver package.

Figure 2:
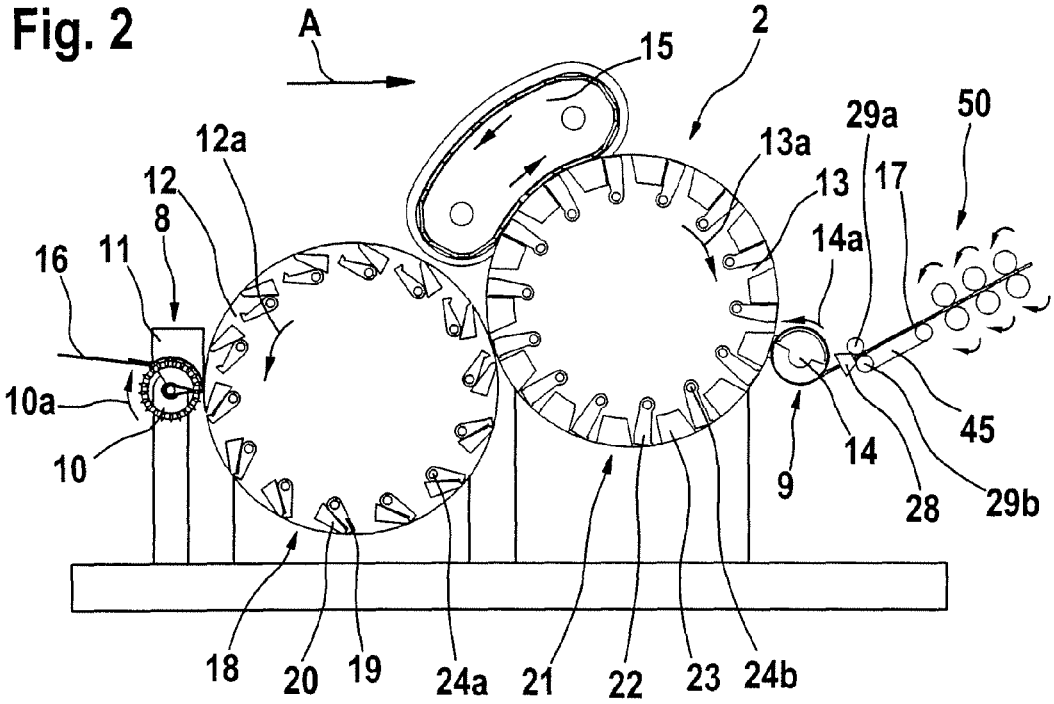
FIG. 2 is a diagrammatic side view of a rotor combing machine according to the invention having two rollers and two combing elements.

FIG. 2 shows a rotor combing machine 2 having a supply device 8 comprising a feed roller 10 and a feed trough 11, having a first roller 12 (turning rotor), second roller 13 (combing rotor), a take-off device 9 comprising a take-off roller 14 and a revolving card top combing assembly 15. The directions of rotation of the rollers 10, 12, 13 and 14 are shown by curved arrows 10*a*, 12*a*, 13*a* and 14*a*, respectively. The incoming fibre lap is indicated by reference numeral 16 and the delivered fibre web is indicated by reference numeral 17. The rollers 10, 12, 13 and 14 are arranged one after the other. Arrow A denotes the operating direction.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a*, which is attached to the roller 12. The lower nipper 20 is mounted on the roller 12 so as to be either fixed or movable. The free end of the upper nipper 19 faces the periphery of the roller 12. The upper nipper 19 and the lower nipper 20 co-operate so that they are able to grip a fibre bundle (clamping) and release it.

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b*, which is attached to the roller 13. The lower nipper 23 is mounted on the roller 13 so as to be either fixed or movable. The free end of the upper nipper 22 faces the periphery of the roller 13. The upper nipper 22 and the lower nipper 23 co-operate so that they are able to grip a fibre bundle (clamping) and release it. In the case of roller 12, around the roller periphery between the feed roller 10 and the second roller 13 the clamping devices 1 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the doffer 14 and the first roller 12 the clamping devices 21 are open. Reference numeral 50 denotes a drafting system, for example an autoleveller drafting system. The drafting system 50 is advantageously arranged above the coiler head 3*a*. The reference numeral 45 denotes an ascending conveyor, for example, a conveyor belt. An upwardly inclined metal sheet or the like may also be used for conveying.

Figure 3:
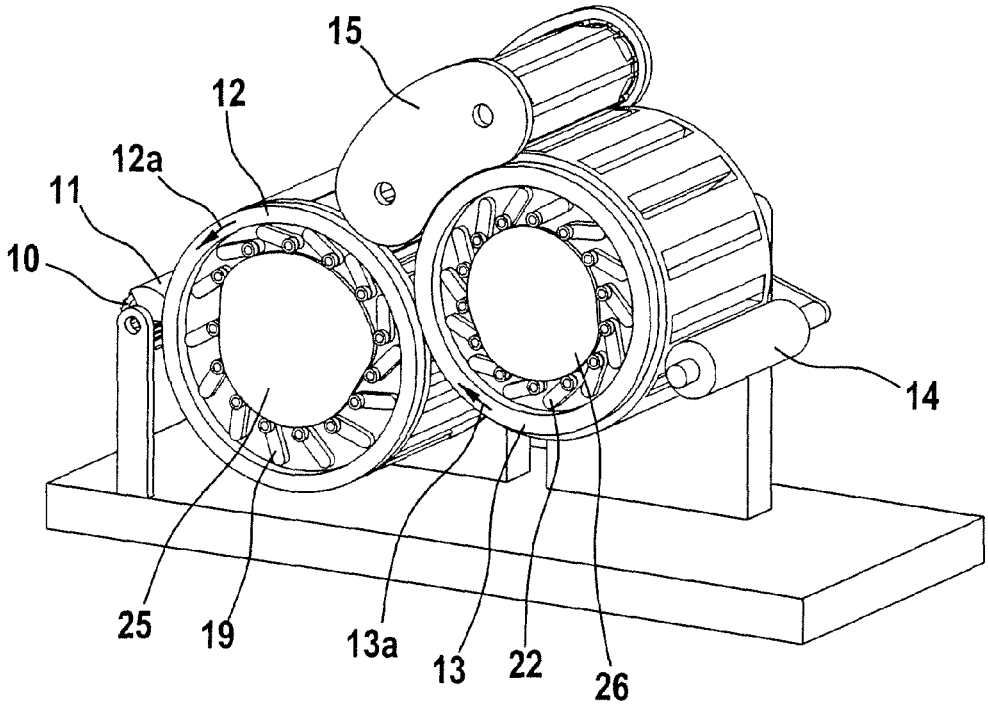
FIG. 3 is a perspective view of the rotor combing machine generally according to FIG. 2 having two cam discs.

In the arrangement of FIG. 3, two fixed cam discs 25 and 26 are provided, about which the roller 12 having the first clamping devices 18 and the roller 13 having the second clamping device 21 are rotated in the direction of arrows 12*a* and 13*a*, respectively. The loaded upper nippers 19 and 22 are arranged in the intermediate space between the outer periphery of the cam discs 25, 26 and the inner cylindrical surfaces of the rollers 12, 13. By rotation of the rollers 12 and 13 about the cam discs 25 and 26 respectively, the upper nippers 19 and 22 are rotated about pivot axes 24*a* and 24*b*, respectively. In that way, the opening and closing of the first clamping devices 18 and the second clamping devices 21 is implemented.

Figure 4A:
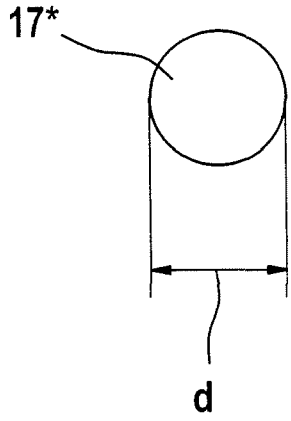
FIG. 4*a* shows a cross-section through a fibre sliver of combed fibre material.
Figure 4B:
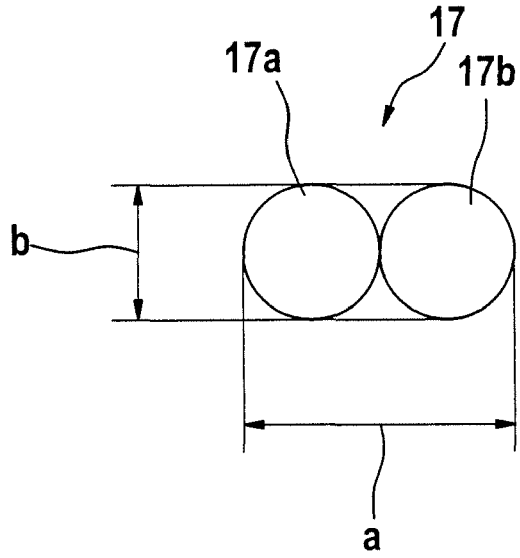
FIGS. 4*b* to 4*d* show diagrammatically the formation of a fibre structure by increasing the width and decreasing the height.
Figure 4C:
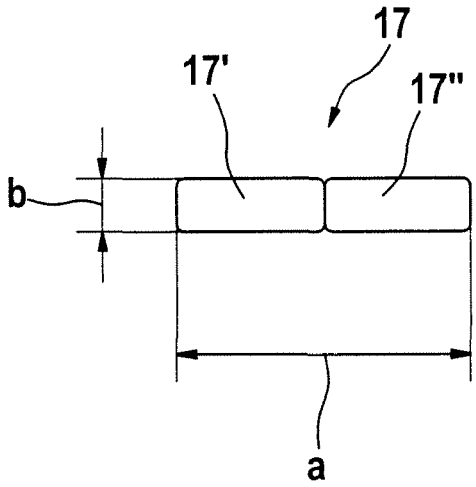
Figure 4D:
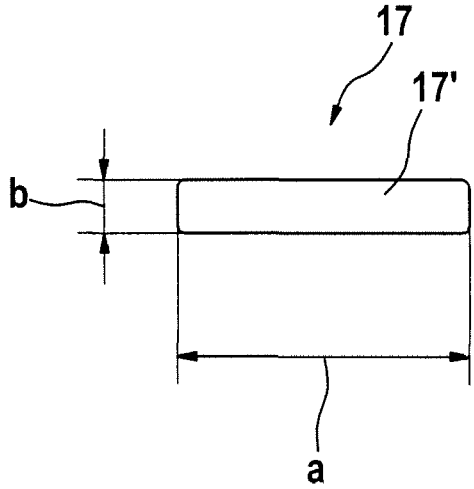

Referring to FIG. 4*c*, the fibre structure 17 consists of two flat slivers 17', 17", the width a being greater than the height b. The fibre structure 17 according to FIG. 4*c* has been produced by expanding two substantially round slivers using a web width-expander (see FIG. 12). In accordance with FIG. 4*d*, the fibre structure 17 consists of a flat sliver 17', the width a of which is greater than its height b. The fibre structure 17 according to FIG. 4*d* can likewise be formed by means of a web width-expander (see FIG. 12).

Figure 5:
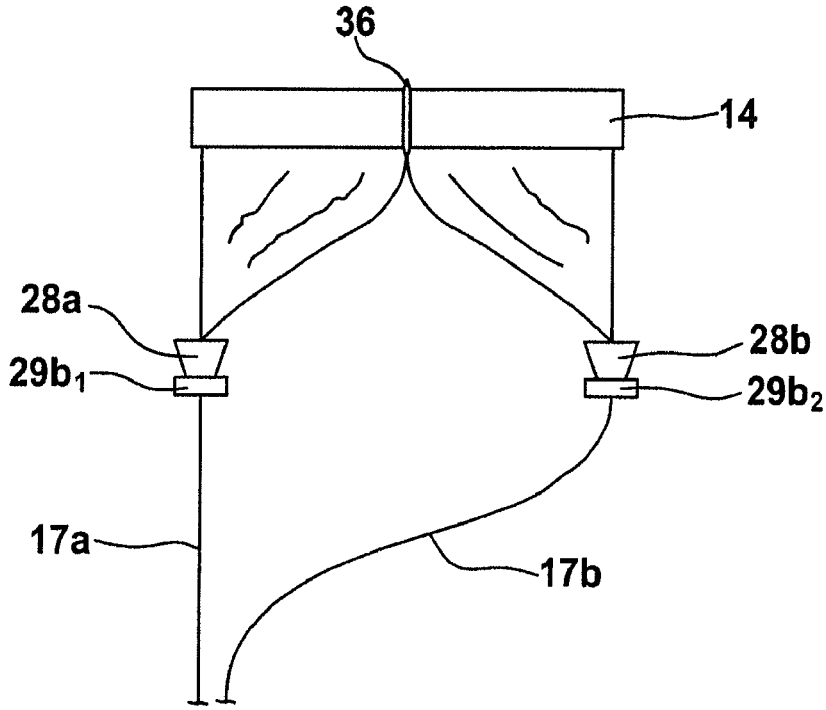
FIG. 5 shows diagrammatically the production of two fibre slivers after division of a web.

FIG. 5 shows a first illustrative embodiment for the production of two fibre slivers 17*a*, 17*b* following a web division. The combed fibre material coming from the doffer roller 14 is divided approximately in the middle, each portion—viewed in the running direction B—passing through a respective sliver funnel 28*a* and 28*b* with delivery rollers $\mathbf{29}b_1$ and $\mathbf{29}b_2$. The fibre slivers 17*a*, 17*b* then converge again and form the fibre structure 17 shown in FIG. 4*b*.

Figure 6:
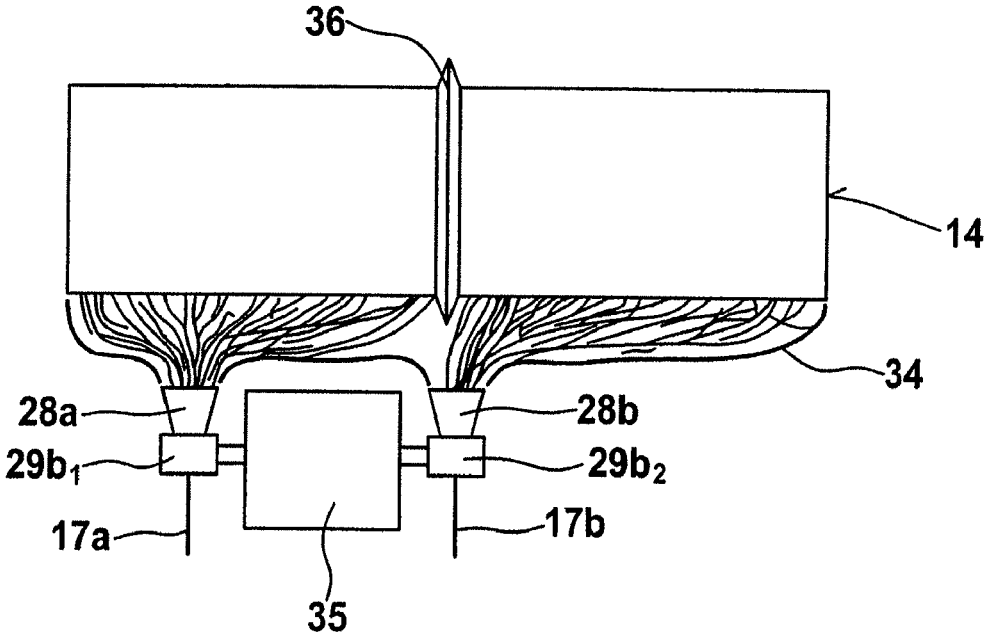
FIG. 6 shows a construction for web division with a stationary web guide plate and asymmetrically arranged delivery roller pairs.

In the embodiment of FIG. 6, a stationary guide element 34 having two circular openings is arranged downstream of the doffer roller 14 (piecing roller). In relation to the guide element 34, the delivery roller pair $\mathbf{29}b_2$ is arranged in the middle, i.e. symmetrically, and the delivery roller pair $\mathbf{29}b_1$ is arranged laterally offset, i.e. asymmetrically. The delivery roller gear 35 is arranged between the delivery roller pairs $\mathbf{29}b_1$ and $\mathbf{29}b_2$ and drives these jointly. Each sliver funnel 28*a* and 29*b* has its own delivery roller pair $\mathbf{29}b_1$ and $\mathbf{29}b_2$ arranged downstream.

Figure 7:
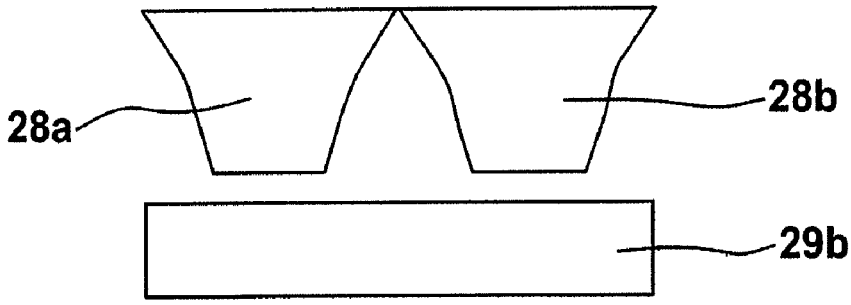
FIG. 7 shows two sliver funnels, downstream of which a common delivery roller pair is arranged.

In the embodiment of FIG. 7, a common delivery roller pair 29*a*, 29*b* is arranged downstream of two sliver funnels 28*a*, 28*b*.

Figure 8:
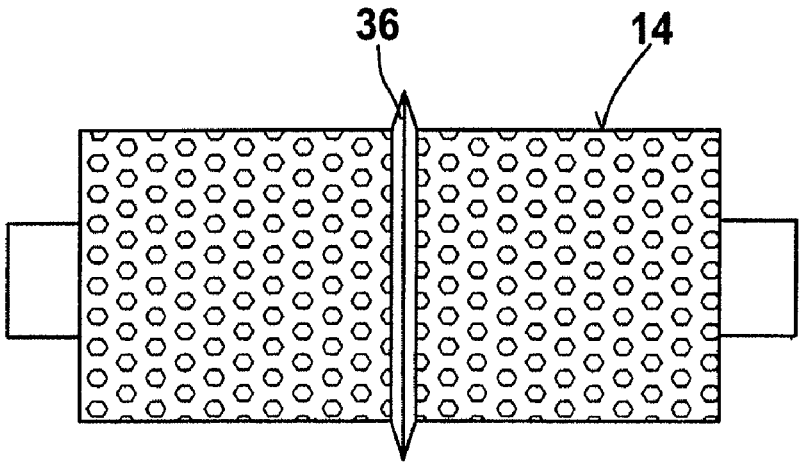
FIG. 8 shows a piecing roller with a separation blade.

FIG. 8 shows one suitable arrangement for the take-off roller 14 of the embodiment of FIGS. 5 and 6. The take-off roller 14 (piecing roller) has a centrally arranged separating blade 36, with which web division is effected directly during the piecing process (cf. FIG. 5).

Figure 9A:
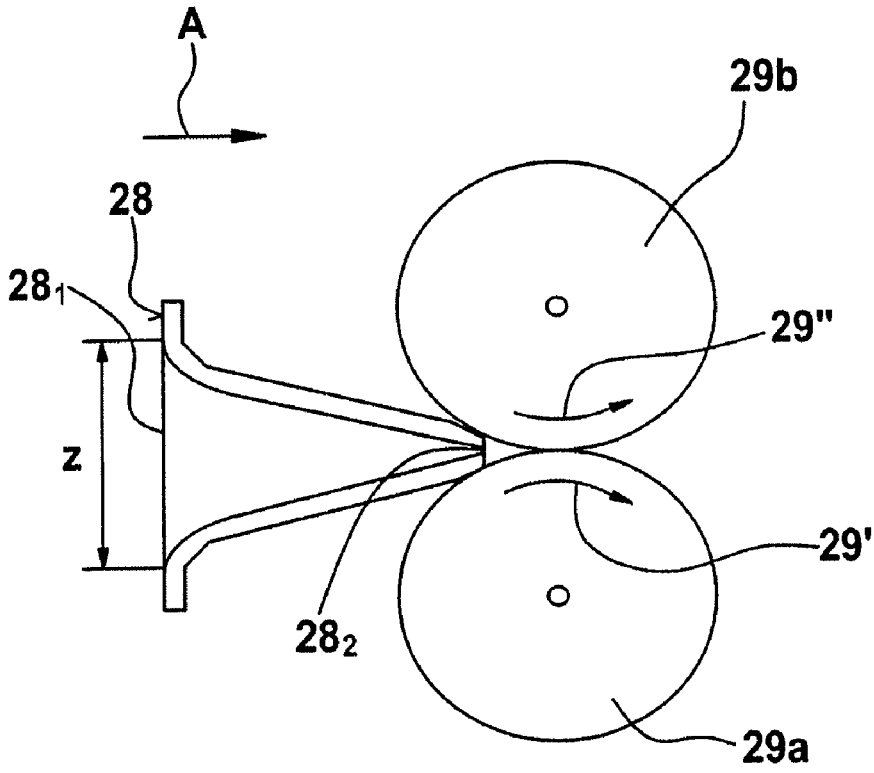
FIGS. 9*a*, 9*b* show in side view (FIG. 9*a*) and in front view (FIG. 9*b*) a sliver funnel with an elongate outlet opening (in cross-section)
Figure 9B:
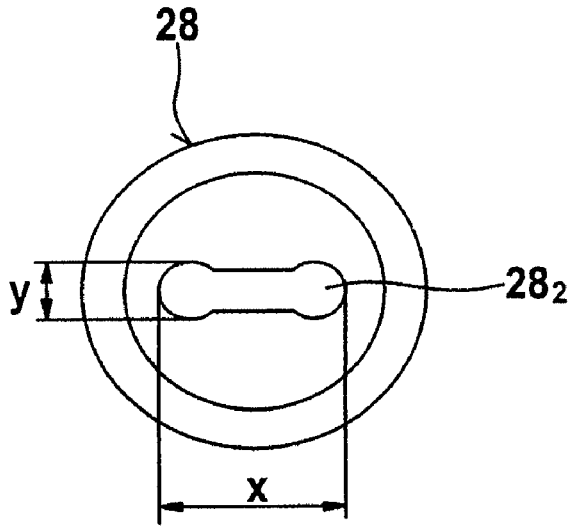
Figure 10:
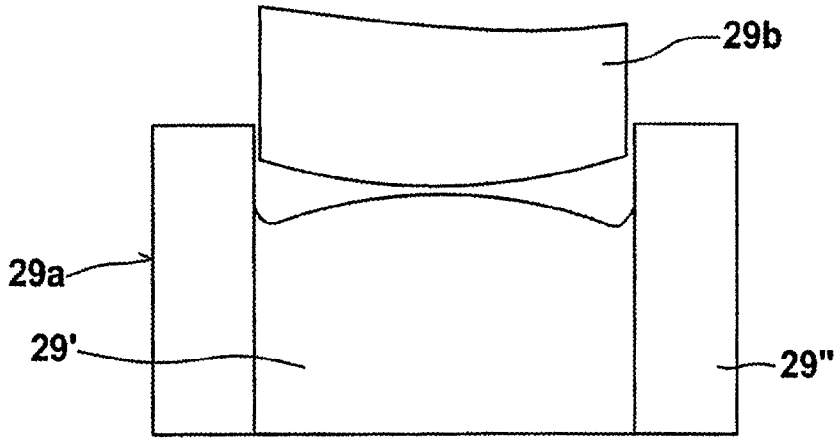
FIG. 10 is a partial cross-section through a delivery roller pair comprising groove and tongue rollers each having a convexly curved outer circumferential surface.

In the embodiment of FIG. 9, the delivery rollers 29*a*, 29*b* (which rotate in direction 29' and 29" respectively) are arranged downstream of the sliver funnel 28. The sliver funnel 28 is designed to converge conically in the working direction A. The height z of the inlet region $\mathbf{28}_1$ is greater than the height y (see FIG. 9*b*) of the outlet region $\mathbf{28}_2$. The width x of the outlet region $\mathbf{28}_2$ is greater than its height y, as shown in FIG. 9*b*. The flat outlet region $\mathbf{28}_2$ leads to a flat formation of the fibre structure 17 emerging from the funnel 28*a* in the form of a flat sliver. The height b of the two edges of the flat sliver 17 is greater than the height of the central region. A sliver structure in which the edges are of greater height than the central region can also be achieved with the device according to FIG. 10, in which a delivery roller 29*a* is in the form of a grooved roller and a delivery roller 29*b* is in the form of a tongued roller. As the combed fibre material passes through the sliver funnel 28 and subsequently through the roller nip between the rollers 29*a*, 29*b*, a fibre structure having thicker edge regions compared with the central region is produced. The edge fibres are thus securely gripped in the drafting system 50 and a uniform drafting is effected. It will be appreciated that it is not necessary to use both the sliver funnel construction of FIG. 9*b* and the delivery roller construction of FIG. 10 to obtain a flat sliver with edges of greater height than a central region (although the use of both together is not excluded).

Figure 11:
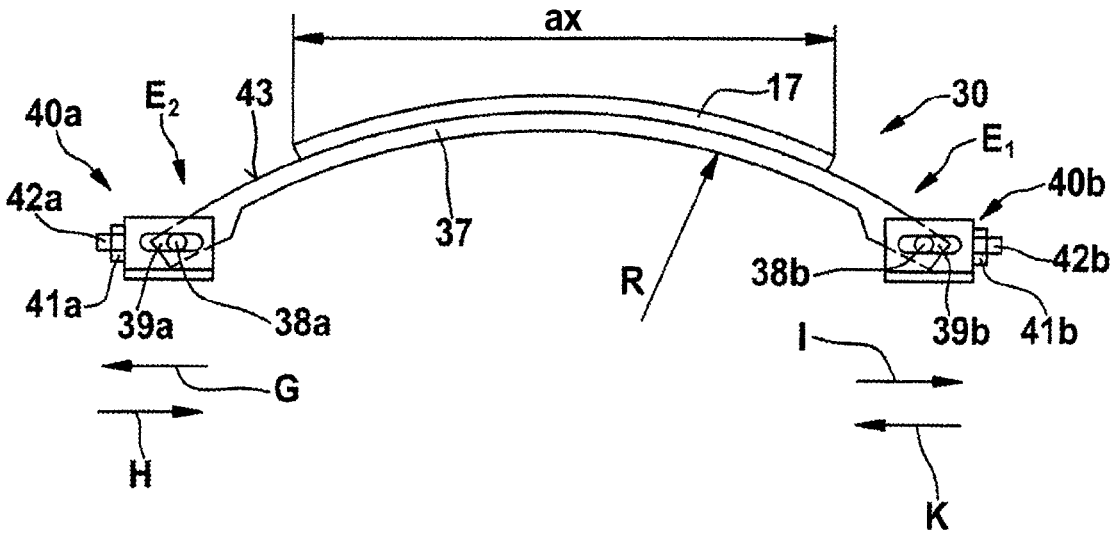
FIG. 11 is a front view of a web width-expanding arrangement with adjustable lateral guides.

A front view of a first embodiment of a web width-expander 30 is illustrated in detail in FIG. 11. Here, the web width-expander 30 is formed from a resilient rod 37, which is provided with reinforcements in its end regions E1 and E2. In the said end regions in the area of the reinforcements, respective pins 38*a*, 38*b* are provided, which on both sides engage in respective slots 39*a*, 39*b* of a holding device 40*a*, 40*b*. Each holding device is provided with two lateral webs in which the slots 39*a*, 39*b* are arranged. The bolts 38*a*, 38*b* pass on both sides through the webs via the slots 39*a*, 39*b*. The holding device 40*a*, 40*b* is additionally provided with a cross-member, which on the one hand connects the webs 11 to one another and on the other hand is used to receive a nut 41*a*, 41*b*. The nut is fixedly connected to the cross-member. For displacement into the bowed state, the threaded pins 42*a*, 42*b* are turned towards the middle, whereby the pins 38*a*, 38*b*, on which the threaded pins bear with their ends, are displaced inwards. Due to the flexural strength selected over the cross-sectional shape of the web width-expander, the rod is able to yield only in one direction, namely in the plane that is located transversely to the direction of transport of the fibre web. The radius of curvature R can be adjusted by corresponding turns of the threaded pins 42*a*, 42*b*. During this displacement, the pin in the respective holding devices moves in the slot, since the holding device is firmly fixed or secured in the region of the housing. Depending on the adjustment of the magnitude of the bending radius R, the width B of the fibre web guided on the guide surface 43 can be influenced. This means that the smaller the radius R is set to be, the more the fibre web is pulled apart owing to the tension force that develops, whereby the width a enlarges. The arrows G, H, I, K denote the directions in which the bolts 38*a*, 38*b* are moved within their respective slots 39*a*, 39*b*.

Figure 12:
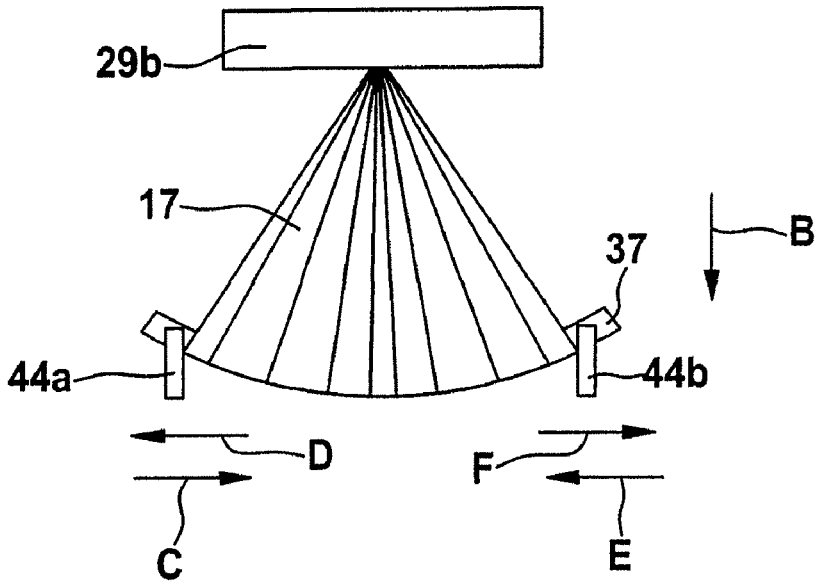
FIG. 12 is a plan view of a web width-expanding arrangement with adjustable lateral guides.

FIG. 12 shows a plan view of another embodiment of web-width expander, in which the combed fibre sliver 17 emerging from the delivery rollers 29*a*, 29*b* (only 29*b* is shown) is expanded in width to form a wide fibre structure. The fibre structure lies on the curved element 37, which in many respects is of similar construction to the correspondingly numbered curved element in FIG. 11. Reference numerals 44*a*, 44*b* denote adjustable lateral guides, which are displaceable in directions C, D and E, F respectively and thereby limit the width a of the fibre structure 17.

Figure 13:
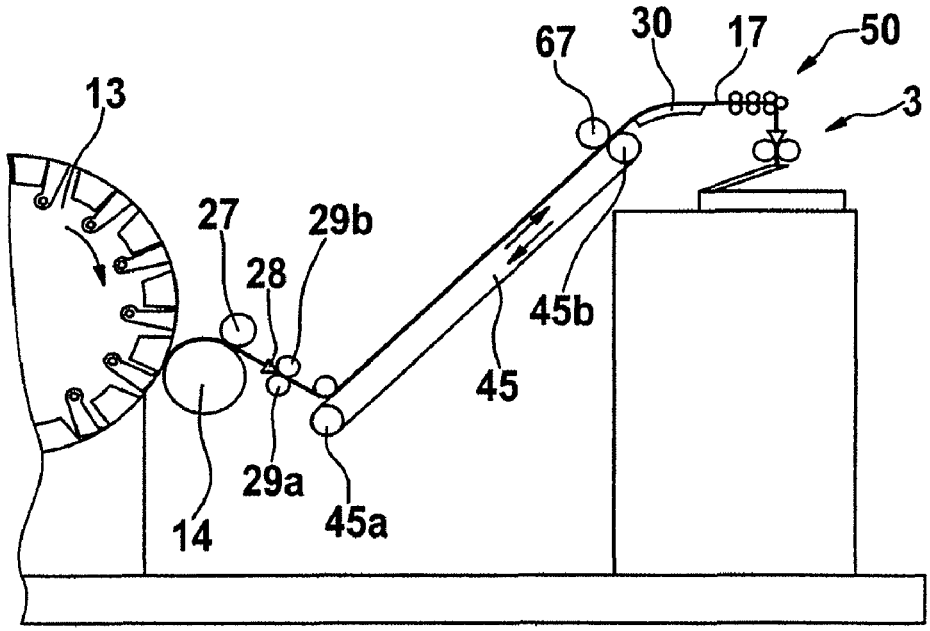
FIG. 13 shows an embodiment with a web width-expander between an upstream ascending conveyor and a downstream drafting system.

In the embodiment of FIG. 13, a sliver funnel 28 with two downstream calender rollers 29*a*, 29*ba* is arranged as the sliver-forming element between the conveyor belt 45 and the take-off roller 14. A pressure-applying roller 27 is associated with the take-off roller 14. Furthermore, a calender roller 67 is provided as pressure-applying element close to the upper guide roller 45*b* of the conveyor belt 45. Between the upper guide roller 45*b* and the feed rollers of the drafting system 50 there is arranged a web width-expander 30, over the preferably curved and polished surface of which the combed fibre sliver runs. The sliver width-expanding arrangement 30 disposed between the conveyor belt 45 and the drafting system 50 widens the combed fibre sliver to a thin fibre structure or fibre web, the width a of which is greater than its height b. The fibre sliver 17 is subsequently guided into and through the drafting system 50.

Figure 14:
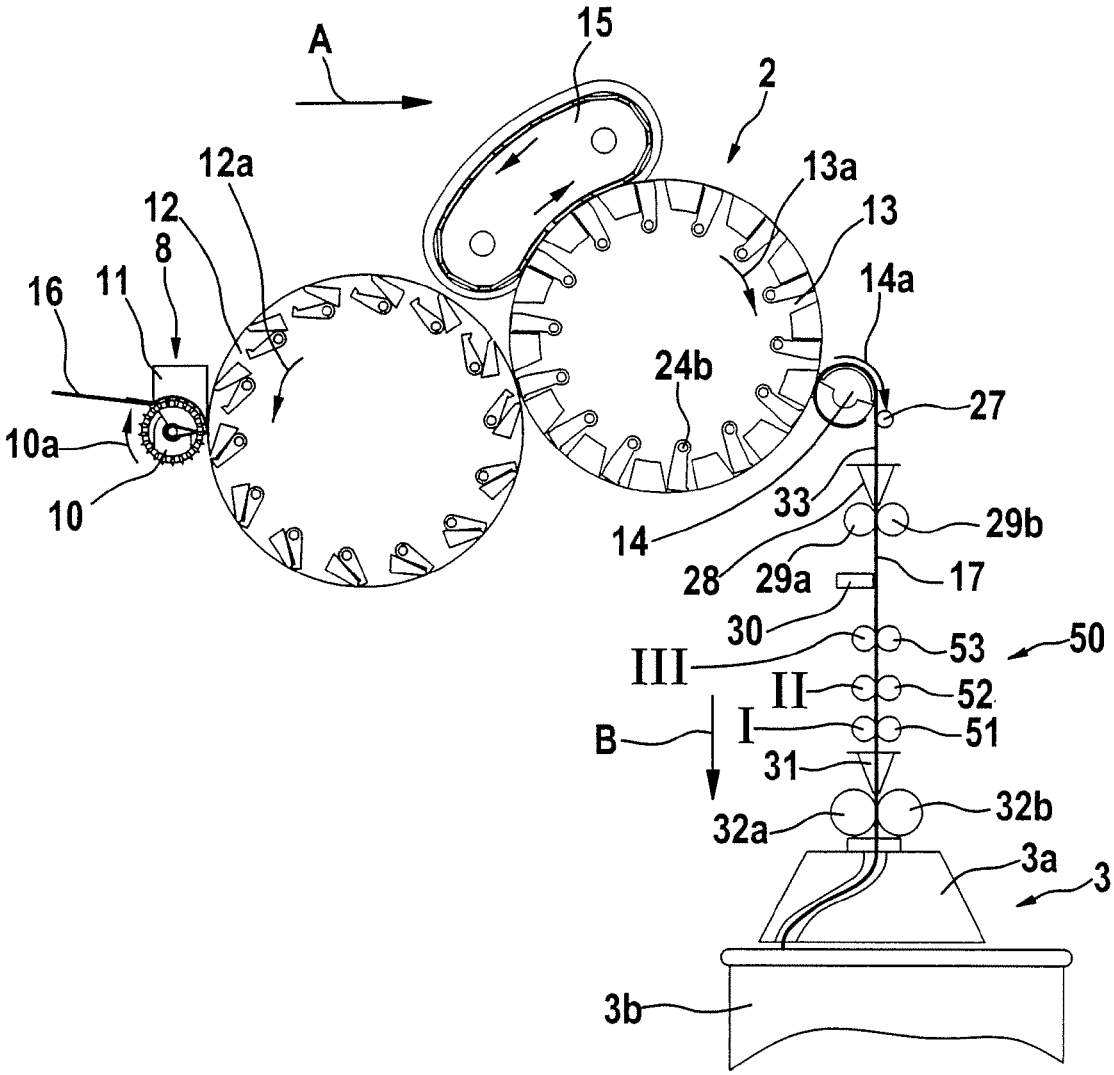
FIG. 14 shows an embodiment with a vertical arrangement of the drafting system above a fibre sliver-deposition device and with a web expander upstream of the drafting system.

In the embodiment of FIG. 14 a vertical arrangement of the drafting system 50 above the sliver-deposition device 3 and an ascending arrangement of the turning rotor 12 and the combing rotor 13 are provided. The drafting system 50 is arranged beneath the take-off roller 14. Associated with the take-off roller—rotating clockwise—is a stripping roller 27, which rotates anticlockwise. The use of the stripping roller 27 having a defined clamping line serves for removal of the fibre material from the take-off roller 14 and guidance thereof vertically downwards (direction B) into a sliver funnel 28, to form a fibre sliver. The drafting system 50 is arranged vertically below the sliver funnel 28. Vertically below the drafting system 50 there is a sliver funnel 31 with two delivery rollers 32*a*, 32*b*. The construction shown in FIG. 14 shows a 3-over-3 drafting system 50, which consists of three bottom rollers I, II, III (I being the bottom delivery roller, II being the bottom middle roller and III being the bottom feed roller) and three top rollers 51 to 53. Drafting of the fibre sliver 17 takes place in the drafting system 50. The draft is made up of the preliminary draft and the main draft. The roller pairs 53/III and 52/II form the preliminary draft zone and the roller pairs 52/II and 51/I form the main draft zone. The bottom delivery roller I is driven by a servo motor (not illustrated). The bottom feed and bottom middle roller III and II respectively are driven by a main motor (not illustrated) and thus determine the delivery speed. The direction of rotation of the rollers I, II, III and 51 to 53 is indicated by curved arrows. The fibre sliver 17 runs in the drafting system in direction A. A sliver width-expanding arrangement 30 is arranged between the delivery rollers 29*a*, 29*b* and the feed roller pair 53/III of the drafting system 50.

Figure 16:
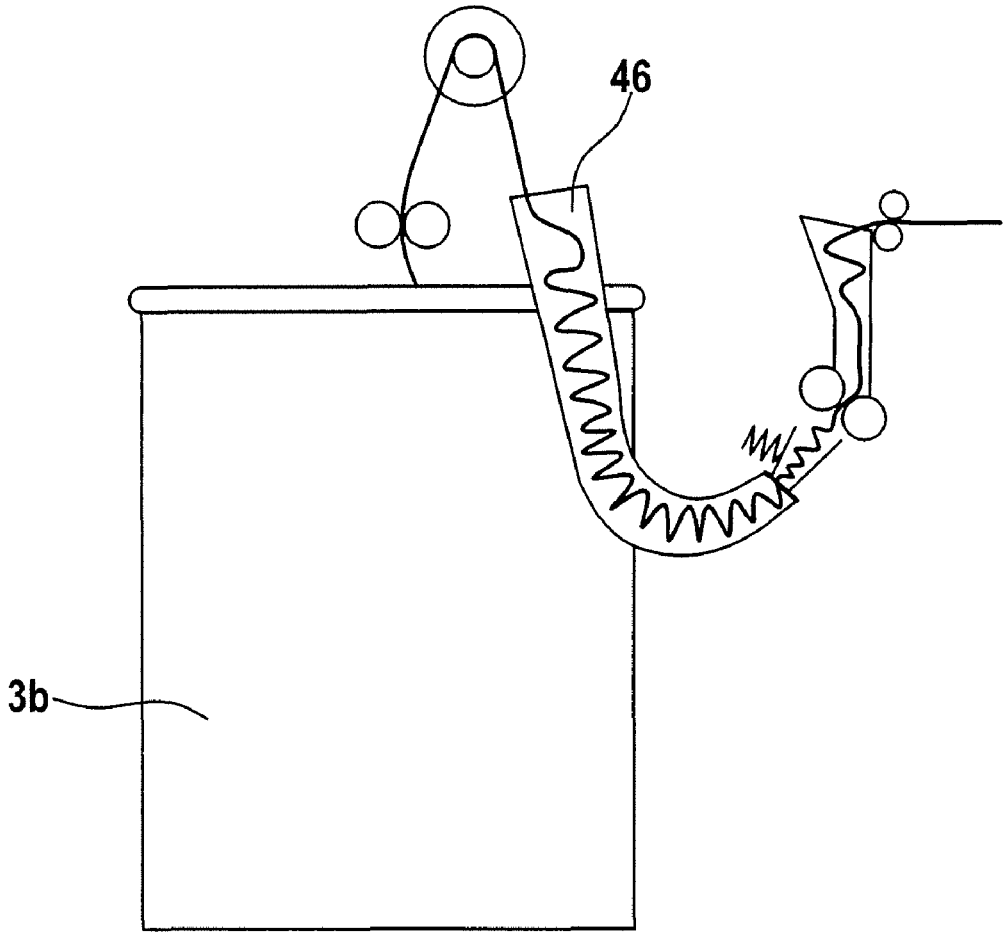
FIG. 16 is a diagrammatic side view of a sliver deposition arrangement with a stuffer box.

FIG. 16 shows a diagrammatic side view of a stuffer box 46, containing combed fibre material, which may be positioned upstream of the sliver deposition device. The stuffer box 46 can be used to increase the fibre-to-fibre adhesion after sliver formation upstream or downstream of the drafting system 50.

Figure 15:
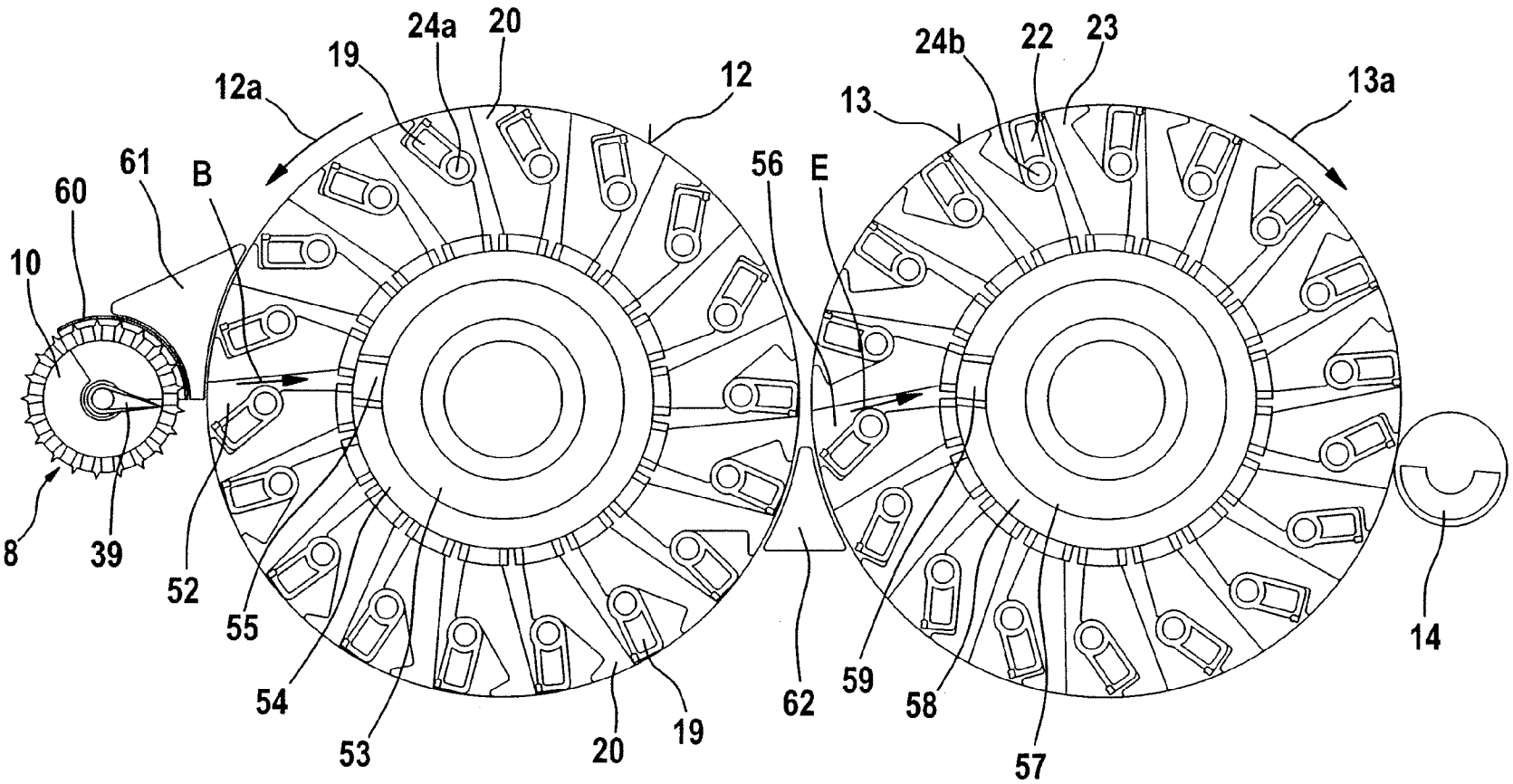
FIG. 15 shows a rotor combing machine as in FIG. 2, in which suction devices are associated with the clamping devices.

FIG. 15 shows a further possible construction for a rotor combing machine for use in an apparatus according to the invention. The rotatably mounted rollers 12 and 13 with clamping devices 19, 20 and 22, 23 respectively are additionally fitted with suction channels 52 and 56 respectively (suction openings) which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery to the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper). In the interior of the rotors 12, 13 there is a reduced pressure region 53 to 55 and 57 to 59, respectively, created by the suction flow at the suction openings 52, 56. The reduced pressure can be generated by connecting to a flow-generating machine. The suction flow at the individual suction openings 52, 56 can be so switched between reduced pressure region and suction opening that it is applied only at particular selected angular positions on the roller circumference. For the purpose of the switching, valves or a valve pipe 54, 58 with openings 55 and 59, respectively, in the corresponding angular positions can be used. The release of the suction flow may also be brought about by the movement of the gripping element (upper nipper). Furthermore, it is possible to arrange a region of reduced pressure only at the corresponding angular positions.

Additionally, a flow of blown air can be provided in the region of the supply device 8 and/or in the region of transfer between the rollers. The source of the flow of blown air (blowing nozzle 39) is arranged inside the feed roller 10 and acts, through the air-permeable surface of the supply device or through air passage openings, towards the outside in the direction of the first roller. Also, in the region of the supply device 8, the element for producing the blown air current can be fixedly arranged, directly under or over the supply device 8. In the region of the transfer between the rollers 12, 13 the blown air current sources can be arranged at the rotor perimeter of the first roller 12, directly under or over each nipper device. For the blown air generation there may be used compressed air nozzles or air blades.

The suction flow B is able not only to promote the deflection but also the process of separating the lap and the fibre tuft to be detached in the region of the supply device 8, and to shorten the time required for this.

As a result of the provision of additional air guide elements 60 and lateral screens 61, 62 the direction of the flow can be influenced and the air carried round with the rotors separated off. In that way the time for alignment can be further shortened. In particular, a screen element between the first rotor 12 and supply device 8 over the lap and a screen element on each side of the roller have proved useful.

The combed-out fibre portion 303 passes from the second roller 13 onto the piecing roller 14.

In use of the rotor combing machine according to the invention there is achieved a mechanical combing of the fibre material to be combed, that is, mechanical means are used for the combing. There is no pneumatic combing of the fibre material to be combed, that is, no air currents, e.g. suction and/or blown air currents, are used.

In the rotor combing machine according to the invention there are present rollers that rotate rapidly without interruption and that have clamping devices. Rollers that rotate with interruptions, stepwise or alternating between a stationary and rotating state are not used.

The circumferential speeds are, for example, for the feed roller about from 0.2 to 1.0 m/sec; the first roller 12 about from 2.0 to 6.0 m/sec; the second roller 13 about from 2.0 to 6.0 m/sec; the doffer about from 0.4 to 1.5 m/sec; and the revolving card top assembly about from 1.5 to 4.5 m/sec. The diameter of the first roller 12 and the second roller 13 is, for example, about from 0.3 m to 0.8 m.

Using the rotor combing machine 2 according to the invention, more than 2000 nips/min, for example from 3000 to 5000 nips/min, are achieved.

Although the foregoing invention has been described in detail by way of illustration and example for purposes of understanding, it will be obvious that changes and modifications may be practised within the scope of the appended claims.

What is claimed is:

1. An apparatus for the fibre-sorting or fibre-selection of a fibre bundle comprising textile fibres, the apparatus comprising:

a fibre sorting device comprising at least a first roller and a second roller that rotate rapidly without interruption during use;

clamping devices distributed about the periphery of the first roller and the second roller, each clamping device adapted to clamp a bundle of the textile fibres at a clamping site located at a distance from a free end of the bundle;

a supply device adapted to supply the fibre bundle to the fibre-sorting device;

at least one mechanical device adapted to generate a combing action from the clamping site to the free end of the fibre bundle in order to loosen and remove non-clamped constituents;

a take-off device comprising at least one sliver-forming element; and a drafting device located downstream of the at least one sliver-forming element;

wherein the at least one sliver-forming element is located between the take-off device and the drafting device, and the at least one sliver-forming element is adapted to form the combed fibre material into a fibre structure having a cross section defining a width and a height, wherein the width is greater than the height.

2. An apparatus according to claim 1, wherein the sliver forming element includes a plurality of portions that divide the combed fibre material into at least two fibre slivers.

3. An apparatus according to claim 2, wherein the take-off device comprises a piecing roller having a separating element, wherein the piercing roller pierces the combed fibre bundles to form a web, and the separating element divides the combed fibre material into the at least two fibre slivers.

4. An apparatus according to claim 3, wherein the at least two fibre slivers pass into and through the drafting device.

5. An apparatus according to claim 1, further comprising a spreading arrangement that expands the width of the fibre sliver, the spreading arrangement located between the sliver-forming element and the drafting device.

6. An apparatus according to claim 1, further comprising a device that reconfigures the combed fibre material into a fibre structure having an essentially flat cross-section, the device located downstream from the take-off device.

7. An apparatus according to claim 1, further comprising a spreading device located between said sliver-forming element and the drafting device, wherein the spreading device expands the fibre sliver or slivers in width to a thin fibre web.

8. An apparatus according to claim 7, wherein the spreading device comprises a curved guide member adapted to influence the cross-section of the fibre sliver or fibre slivers.

9. An apparatus according to claim 8, wherein the curved guide member comprises elements for lateral limitation.

10. An apparatus according to claim 8, wherein the guide member includes a contact surface that contacts the fibre structure, wherein the contact surface is convexly curved.

11. An apparatus according to claim 10, wherein the contact surface is stationary.

12. An apparatus according to claim 10, wherein the contact surface is mobile.

13. An apparatus according to claim 1, further comprising at least one web width-expander located upstream of the drafting device.

14. An apparatus according to claim 1, further comprising a pair of rollers between said sliver-forming element and the drafting device, wherein the pair of rollers have circumferential surfaces adapted to expand the width of the fibre sliver.

15. An apparatus according to claim 1, wherein said sliver-forming element comprises a sliver funnel having an outlet region adapted to discharge a flat fibre structure.

16. An apparatus according to claim 1, wherein the sliver-forming element comprises a sliver funnel having an outlet region located in a roller nip between a pair of delivery rollers.

17. An apparatus according to claim 1, wherein the fibre structure leaving the sliver-forming element has a substantially rectangular cross-section.

18. An apparatus according to claim 1, further comprising a stuffer box located downstream of the sliver-forming element, wherein the stuffer box is located upstream or downstream of the drafting device.

19. An apparatus according to claim 1, further comprising at least one conveying element for the fibre structure located between the sliver-forming element and the drafting device.

20. An apparatus according to claim 1, comprising at least two take-off devices and at least two sliver-forming elements, wherein the at least two slivers are fed to a common drafting device.

21. An apparatus according to claim 1, wherein said first roller comprises a turning rotor and said second roller comprises a combing rotor, wherein the turning rotor and the combing rotor rotate in opposite directions.

* * * * *